US010878786B2

(12) United States Patent
Yoshino

(10) Patent No.: US 10,878,786 B2
(45) Date of Patent: Dec. 29, 2020

(54) PERCUSSION INSTRUMENT AND TENSION APPLYING METHOD

(71) Applicant: Roland Corporation, Shizuoka (JP)

(72) Inventor: Kiyoshi Yoshino, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 16/724,401

(22) Filed: Dec. 23, 2019

(65) Prior Publication Data

US 2020/0211515 A1 Jul. 2, 2020

(30) Foreign Application Priority Data

Dec. 26, 2018 (JP) ..... 2018-242583

(51) Int. Cl.
*G10D 13/02* (2020.01)
*G10D 13/20* (2020.01)

(52) U.S. Cl.
CPC ..... *G10D 13/02* (2013.01); *G10D 13/20* (2020.02)

(58) Field of Classification Search
CPC ..... G10D 13/02; G10D 13/20
See application file for complete search history.

(56) References Cited

U.S. PATENT DOCUMENTS 5,025,697 A * 6/1991 May ..... G10D 13/22 84/411 R

FOREIGN PATENT DOCUMENTS

JP 2014206671 10/2014

* cited by examiner

*Primary Examiner* — Kimberly R Lockett
(74) *Attorney, Agent, or Firm* — JCIPRNET

(57) ABSTRACT

A percussion instrument and a tension applying method are provided. A frame member where an outer edge of a membrane member is connected is arranged at the other side in the axial direction of a frame, and the frame member is tightened radially inward by a tension ring. The frame member has a predetermined elasticity, and a diameter of the frame member is reduced by a tightening force of the tension ring; thus, the tension may be applied to the membrane member by reducing the diameter of the frame member. That is, an edge portion of the membrane member may be uniformly pressed radially inward over the entire circumference by reducing the diameter of the frame member, and thus the tension may be uniformly applied to the entire membrane member.

20 Claims, 6 Drawing Sheets

PERCUSSION INSTRUMENT AND TENSION APPLYING METHOD

CROSS-REFERENCE TO RELATED APPLICATION

This application claims the priority of Japan patent application serial no. 2018-242583, filed on Dec. 26, 2018. The entirety of the above-mentioned patent application is hereby incorporated by reference herein and made a part of this specification.

BACKGROUND OF THE DISCLOSURE

Technical Field

The disclosure relates to a percussion instrument and a tension applying method, and particularly to a percussion instrument and a tension applying method which may uniformly apply a tension to the entire membrane member.

Related Art

A percussion instrument is known in which a tension is applied to a membrane member of a head by a tightening force directed radially inward of a tension ring. For example, in Japanese Patent Laid-open No. 2014-206671 (for example, paragraph 0048, FIG. 9), a drum is disclosed in which a frame member to which an outer edge of a membrane member is connected is fixed to an upper surface of a frame, and the membrane member is supported by a striking surface support portion formed radially inward from the fixation portion.

In this drum, the striking surface support portion protrudes further upward than the outer edge of the membrane member (a connection portion between the membrane member and the frame member), and thus a space is formed between the membrane member and the frame in a region between the striking surface support portion and the frame member. If a diameter of an outer peripheral member is reduced by the tightening force of the tension ring, the membrane member is pressed toward this space, and thus the tension may be applied to the membrane member.

LITERATURE OF RELATED ART

Patent Literature

[Patent literature 1] Japanese Patent Laid-open No. 2014-206671 (for example, paragraph 0048, FIG. 9)

In this type of percussion instrument, there is a demand for a technique for further equalizing the tension applied to the membrane member by the tightening force directed radially inward of the tension ring.

SUMMARY

In an embodiment of the disclosure, the percussion instrument includes a frame in which an outer peripheral surface of an end portion on a side in an axial direction of the frame is formed in a ring shape, a membrane member covering the side in the axial direction of the frame, a ring-like frame member having a predetermined elasticity to which an outer edge of the membrane member is connected, and a tension ring which tightens the frame member radially inward to reduce a diameter of the frame member in a state that the frame member is disposed closer to the other side in the axial direction than the end portion of the frame on the side in the axial direction.

The disclosure provides a percussion instrument, including: a head which comprises a membrane member configuring a striking surface, and a frame member having a predetermined elasticity to which an outer edge of the membrane member is connected; a frame which supports a peripheral part of the striking surface of the membrane member from below on an opposite side of the striking surface; and a tension ring which radially inward tightens the frame member disposed below a position at which the frame supports the membrane member to apply a tension to the head.

The disclosure provides a percussion instrument, including: a support part in which an outer peripheral surface of an end portion on a side in an axial direction of the support part is formed in a ring shape; a membrane member covering the side in the axial direction of the support part; a ring-like frame member connected to an outer edge of the membrane member and having a predetermined elasticity; and a tension applying part which tightens the frame member radially inward to reduce a diameter of the frame member in a state that the frame member is disposed closer to the other side in the axial direction than the end portion of the support part on the side in the axial direction.

The disclosure provides a tension applying method for applying a tension to a head which comprises a membrane member configuring a striking surface, and a frame member having a predetermined elasticity to which an outer edge of the membrane member is connected. The tension applying method includes: a supporting process for supporting a peripheral part of the striking surface of the membrane member from below on an opposite side of the striking surface by a frame; and a tightening process which is performed after the supporting process and in which the frame member arranged below a position where the frame supports the membrane member is tightened radially inward by a tension ring.

BRIEF DESCRIPTION OF THE DRAWINGS

FIG. 4(*b*) is a partially enlarged cross-sectional view of the drum showing a state in which the tightening force by the tension ring is applied from the state in FIG. 4(*a*); FIG. 4(*c*) is a partially enlarged cross-sectional view of the drum showing a state in which the tightening force by the tension ring is further applied from the state in FIG. 4(*b*); and FIG. 4(*d*) is a partially enlarged cross-sectional view of the drum showing a state in which the tightening force by the tension ring is further applied from the state of FIG. 4(*c*).

DESCRIPTION OF THE EMBODIMENTS

The disclosure provides a percussion instrument and a tension applying method which may uniformly apply a tension to a membrane member.

Figure 1A:
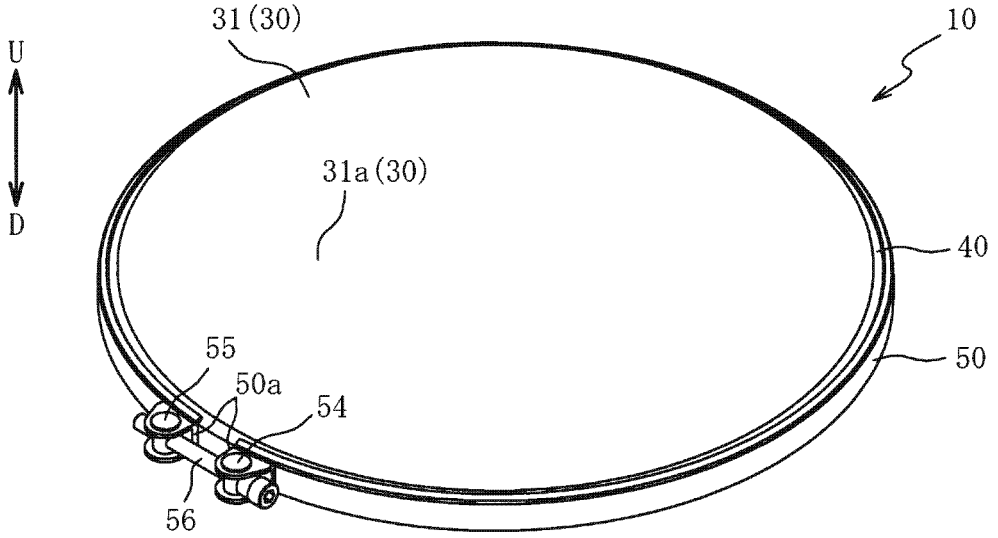
FIG. 1(*a*) is a front perspective view of a drum according to a first embodiment, and FIG. 1(*b*) is a top view of the drum.
Figure 1B:
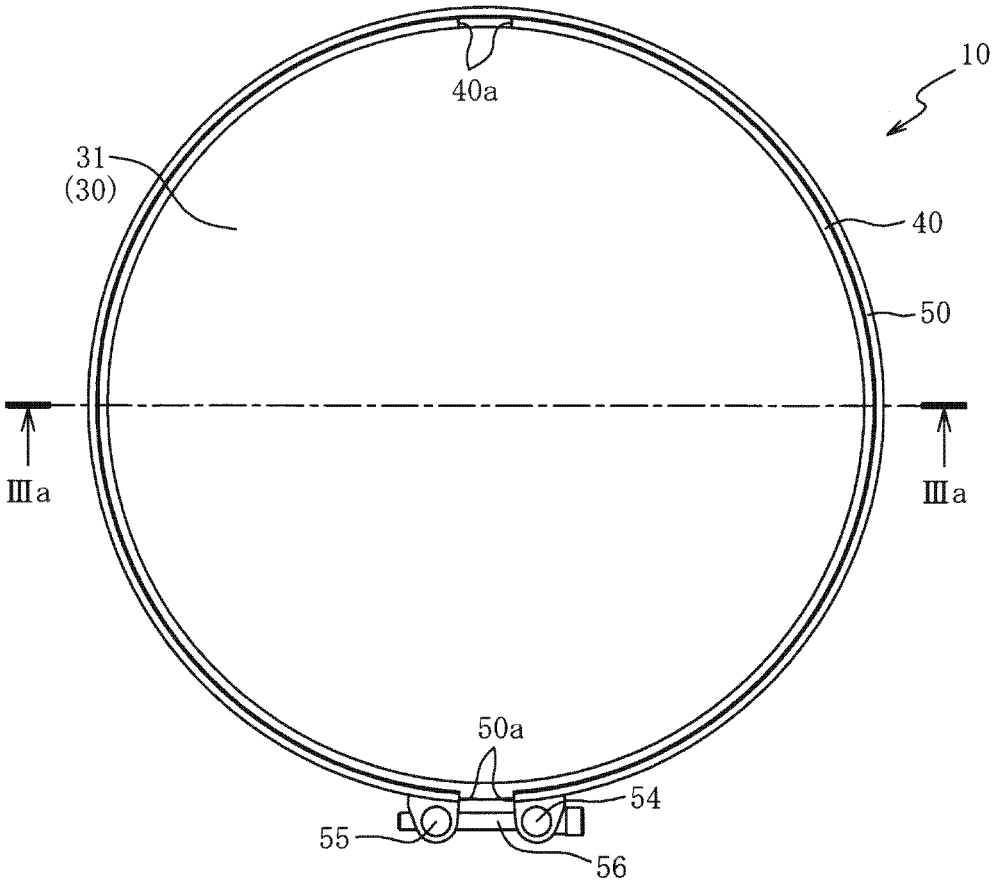
Figure 2:
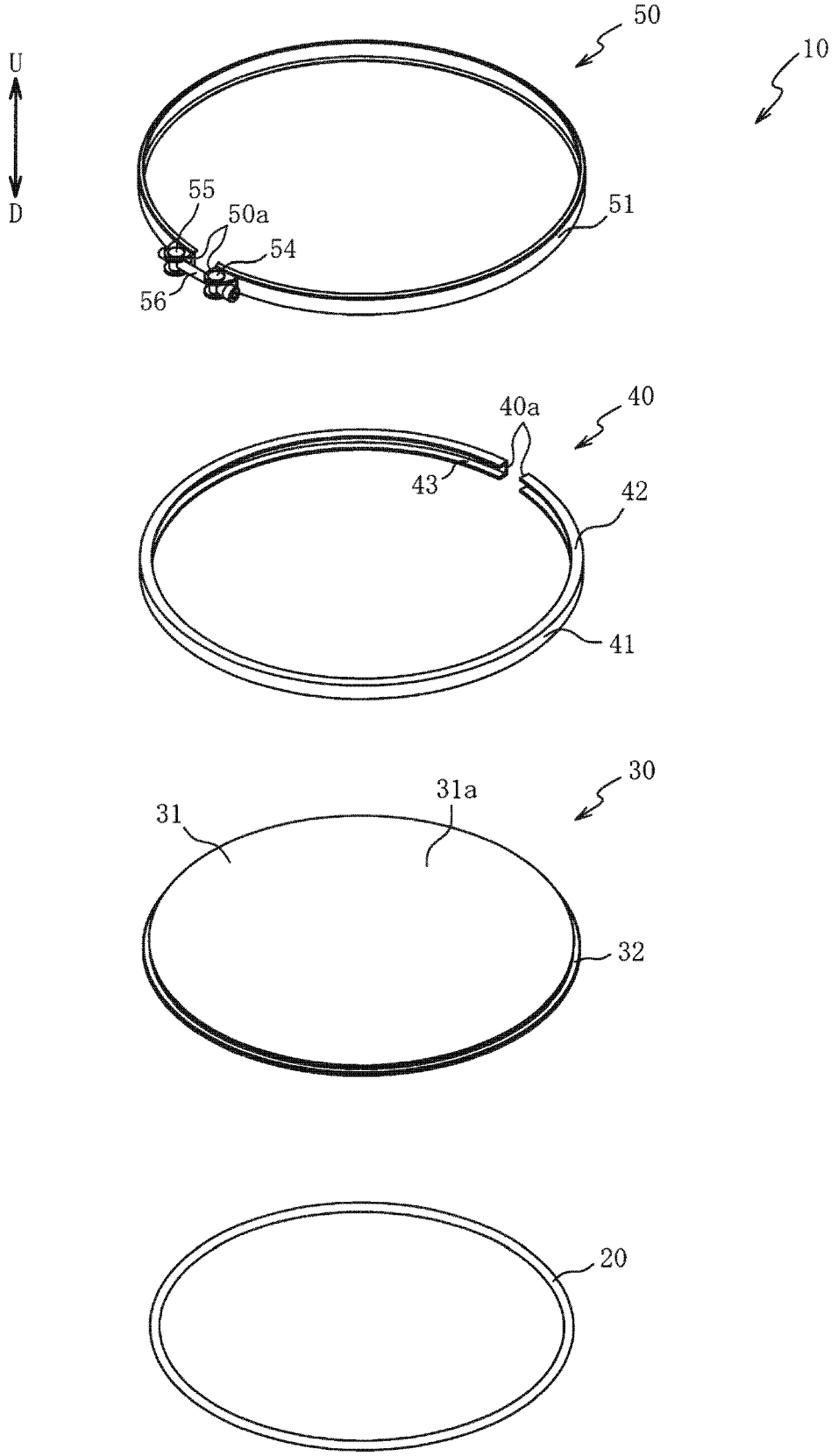
FIG. 2 is an exploded front perspective view of the drum.
Figure 3:
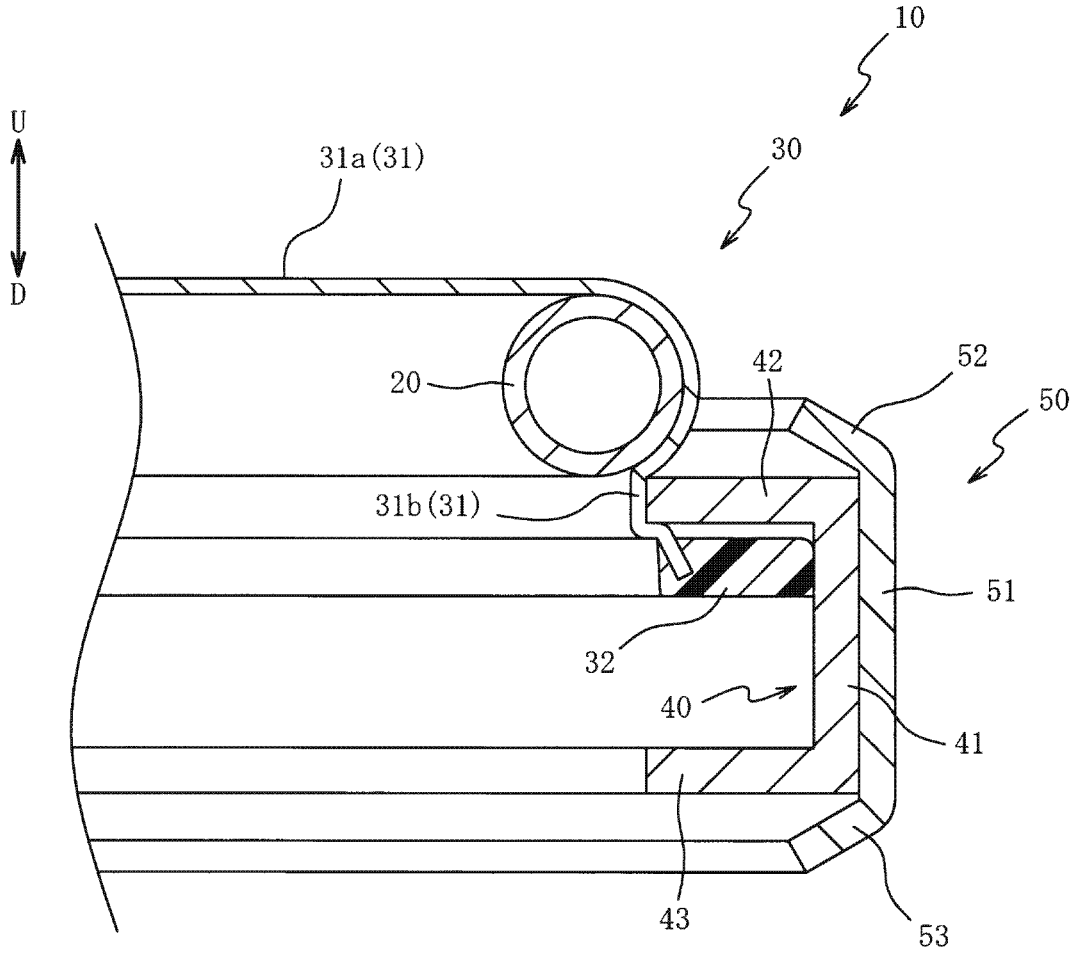
FIG. 3 is a partially enlarged cross-sectional view of the drum along a line III-III in FIG. 1(*b*).
Figure 4A:
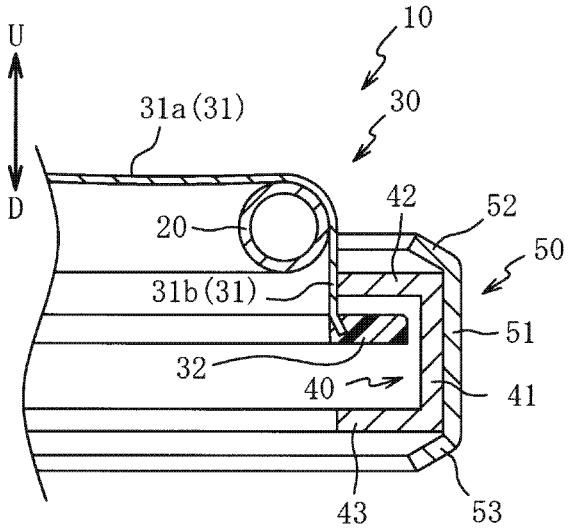
FIG. 4(*a*) is a partially enlarged cross-sectional view of the drum showing a state before a tightening force of a tension ring is applied.
Figure 4B:
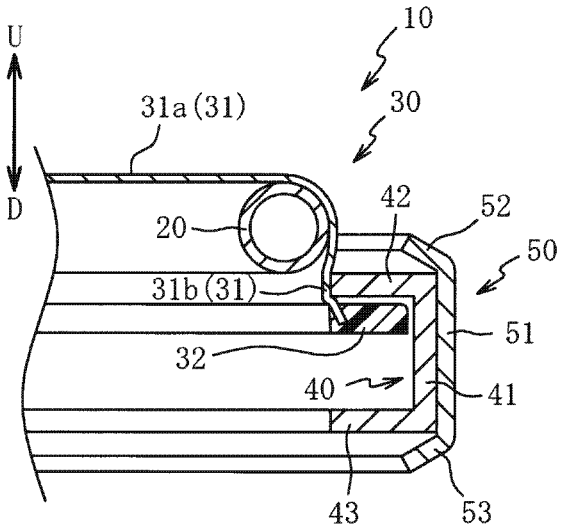
Figure 4C:
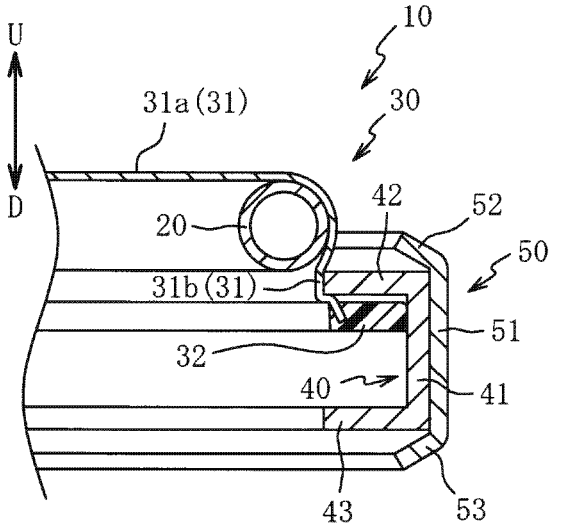
Figure 4D:
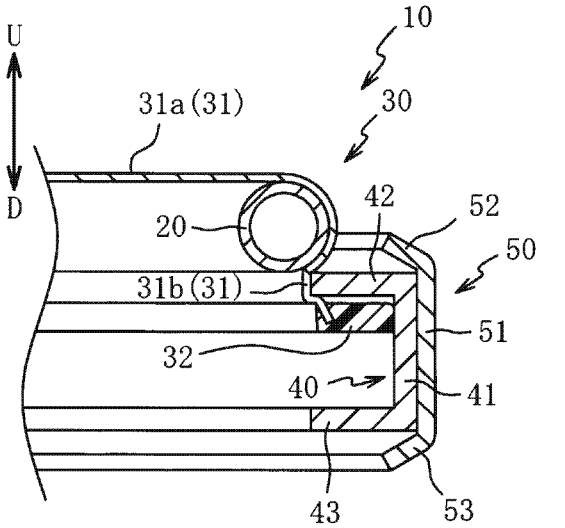

Several embodiments are described below with reference to the accompanying drawings. First, a configuration of a drum 10 in a first embodiment is described with reference to FIG. 1 to FIG. 3. FIG. 1(*a*) is a front perspective view of the drum 10 according to the first embodiment, and FIG. 1(*b*) is a top view of the drum 10. FIG. 2 is an exploded front perspective view of the drum 10. FIG. 3 is a partially enlarged cross-sectional view of the drum 10 along a line III-III in FIG. 1(*b*). Moreover, an arrow U-D in FIG. 1 indicates an up-down direction (an axial direction) of the drum 10, and the same applies to FIG. 2 and subsequent diagrams.

As shown in FIG. 1 and FIG. 2, the drum 10 includes a frame 20, a head 30 supported by the frame 20, and a ring member 40 and a tension ring 50 which apply a tension to a membrane member 31 of the head 30. Moreover, the drum 10 is configured as an electronic drum having a sensor (not shown) which detects vibration caused by hitting a striking surface 31*a* of the head 30, but the drum 10 may also be configured as an electronic tambourine or an acoustic drum.

The frame 20 is formed in an annular shape using a synthetic resin or a metal material. The membrane member 31 of the head 30 is wound around the frame 20, and details will be described later.

The head 30 is a member forming the striking surface 31*a* hit by a stick or the like (not shown). The head 30 includes the membrane member 31 for covering an upper surface side (a side in an axial direction) (an arrow U direction side) of the frame 20 and a frame member 32 connected to an outer edge of the membrane member 31.

The membrane member 31 is formed in a disk shape using a mesh-like material knitted from synthetic fibers, a film-like material formed of a synthetic resin, or the like. An upper surface of the membrane member 31 on an inner peripheral side of the frame 20 is configured as the striking surface 31*a*, and the entire outer edge of the membrane member 31 is connected to the annular frame member 32. The frame member 32 is formed in an annular shape using a synthetic resin having a predetermined elasticity. The frame member 32 is manufactured by mold fabrication, and the membrane member 31 and the frame member 32 are integrally formed by injecting a resin material into a cavity of a mold (not shown) in a state that the outer edge of the membrane member 31 is disposed inside the cavity when the frame member 32 is fabricated. Moreover, the membrane member 31 and the frame member 32 may be connected by adhesion or welding.

The ring member 40 is a member for uniformly applying a tightening force in a radial direction of the tension ring 50 to the head 30 (the membrane member 31 or the frame member 32), and is formed in an annular shape using a synthetic resin harder than the frame member 32, a metal material or wood. In the ring member 40, a split portion 40*a* is formed in which a part in the circumferential direction is divided (notched). In a state before the tightening force of the tension ring 50 is applied (the state shown in FIG. 2), end surfaces of the split portion 40*a* of the ring member 40 are spaced apart from each other via a predetermined interval in the circumferential direction. Thereby, a diameter of the ring member 40 may be easily reduced.

Moreover, in the following description, the state before the tightening force of the tension ring 50 is applied is defined as a "pre-tightening state", and a state that the tightening force of the tension ring 50 reaches a predetermined value and performance is possible is defined as a "tightening state" for description.

The ring member 40 has an outer peripheral portion 41 which configures an outer peripheral surface of the ring member 40, an upper protruding portion 42 which protrudes radially inward from an upper end of the outer peripheral portion 41, and a lower protruding portion 43 which protrudes radially inward from a lower end of the outer peripheral portion 41.

The upper protruding portion 42 and the lower protruding portion 43 project substantially vertically from an inner peripheral surface of the outer peripheral portion 41, and the upper protruding portion 42 and the lower protruding portion 43 are formed substantially in parallel. Therefore, the ring member 40 is formed in a rectangular box shape in which a radial inner side is open, and is configured in a manner that the frame member 32 which is a horizontally long rectangle in a cross-sectional view may be housed in a space surrounded by the outer peripheral portion 41, the upper protruding portion 42, and the lower protruding portion 43.

The tension ring 50 is formed in an annular shape using a synthetic resin or a metal material. In the tension ring 50, a split portion 50*a* in which a part in the circumferential direction is divided (notched) is formed, and end surfaces of the split portion 50*a* of the tension ring 50 face each other with a predetermined interval in the circumferential direction. Moreover, in the following description, a site of the tension ring 50 where the split portion 50*a* is not formed is defined as a "tightening portion 51" for description.

Coupling members 54 and 55 are attached to the end portion of the split portion 50*a* in the circumferential direction, i.e., the outer peripheral surface of the tightening portion 51. The coupling members 54 and 55 are connected by a bolt 56, and are configured in a manner that a distance between the coupling members 54 and 55, that is, an interval of the split portion 50*a* in the circumferential direction may be reduced (or enlarged) by tightening (or loosening) the bolt 56. By reducing (enlarging) the interval of the split portion 50*a*, a diameter of the tightening portion 51 may be reduced (increased).

As shown in FIG. 3, the frame 20 is formed in a hollow circular shape in a cross-sectional view cut along a plane along the axis. In the tightening state, the membrane member 31 (a site configuring the striking surface 31*a*) covers an upper surface side (a side in an axial direction) (an arrow U direction side) of the frame 20, and in a state that the membrane member 31 is wound around (in contact with) an outer peripheral surface of the frame 20, the frame member 32 is arranged on a lower surface side (the other side in the axial direction) (an arrow D direction side) of the frame 20. The ring member 40 is disposed on an outer peripheral side of the frame member 32, and the tightening force of the tension ring 50 is applied to the frame member 32 through the ring member 40. Since the frame member 32 has a predetermined elasticity, by applying the tightening force directed radially inward of the tension ring 50 to the frame member 32, a diameter of the frame member 32 is in a state of being reduced more than the state before tightening, and the details will be described later. Accordingly, the outer edge of the membrane member 31 may be uniformly pressed radially inward over the entire circumference, and thus a tension may be uniformly applied to the entire membrane member 31.

Here, the tightening of the tension ring 50 in the radial direction is performed by tightening the bolt 56 (see FIG. 1 or FIG. 2) and shortening the interval of the split portion 50*a* in the circumferential direction. In this case, an amount of deformation of the tightening portion 51 directed radially inward is likely to be larger in the periphery of the split portion 50*a* than in a position on the opposite side of the split portion 50*a* across an axis. In other words, since the radially inward tightening force in the periphery of the split portion 50*a* is likely to be the largest compared with in other regions, a relatively large tension is applied to the membrane member 31 of the head 30 in the periphery of the split portion 50*a*, whereas the tension applied to the membrane member 31 is relatively small in other regions, particularly in a region on the opposite side of the split portion 50*a* across the axis.

On the other hand, in the embodiment, the ring member 40 is clamped between the frame member 32 and the tension ring 50, and the radially inward tightening force of the tension ring 50 is applied to the frame member 32 via the ring member 40. Thereby, the radially inward tightening force of the tension ring 50 may be dispersed in the circumferential direction by the ring member 40. Therefore, since the diameter of the frame member 32 may be easily reduced uniformly over the entire circumference, the tension may be applied uniformly to the entire membrane member 31.

Here, since the split portion 40*a* is formed in the ring member 40, similarly to the tension ring 50 in which the split portion 50*a* is formed, an amount of radially inward deformation is like to be larger in the periphery of the split portion 40*a* of the ring member 40 than in other regions.

On the other hand, in the embodiment, the split portion 40*a* of the ring member 40 is arranged at a position which is different (shifted) in the circumferential direction from the split portion 50*a* of the tension ring 50 (see FIG. 1(*b*) or FIG. 2). That is, since the split portion 40*a* of the ring member 40 is arranged in a region where the radially inward tightening force of the tension ring 50 is relatively small (the region where the split portion 50*a* of the tension ring 50 is not formed), the radially inward tightening force of the tension ring 50 may be easily applied uniformly over the entire circumference of the frame member 32, and the tension may be applied uniformly to the entire membrane member 31 of the head 30.

In this case, the split portion 40*a* of the ring member 40 and the split portion 50*a* of the tension ring 50 are formed at positions separated in the circumferential direction according to an embodiment of the disclosure. Therefore, at least one part of the split portion 40*a* is disposed at a position overlapping the split portion 50*a* in a radial view (when viewed in a direction perpendicular to the axis) in a region opposite to the split portion 50*a* across the axis according to an embodiment of the disclosure; in another embodiment of the disclosure, the at least one part of the split portion 40*a* is disposed on the opposite side of the split portion 50*a* across the axis (a region farthest from the split portion 50*a* in the circumferential direction). Thereby, the radially inward tightening force of the tension ring 50 may be easily applied more uniformly over the entire circumference of the frame member 32, and the tension may be uniformly applied to the entire membrane member 31 of the head 30.

In addition, the inner peripheral surface of the tightening portion 51 of the tension ring 50 is formed in a manner that an axial dimension is equal to or slightly larger than the outer peripheral surface of the outer peripheral portion 41 of the ring member 40, and the entire inner peripheral surface of the tightening portion 51 of the tension ring 50 and the entire outer peripheral surface of the outer peripheral portion 41 of the ring member 40 are in surface contact. Thereby, the tightening force may be uniformly applied to the ring member 40.

At both ends in the axial direction (an arrow U-D direction) of the tightening portion 51 of the tension ring 50, an upper support portion 52 and a lower support portion 53 are respectively formed in a manner of being inclined and projected toward both sides in the axial direction as the upper support portion 52 and the lower support portion 53 go radially inward. The displacement of the ring member 40 in the axial direction with respect to the tension ring 50 is restricted by the upper support portion 52 and the lower support portion 53.

Since an upper end of the upper support portion 52 of the tension ring 50 is disposed on a lower side (an arrow D direction side) of the striking surface 31*a* of the membrane member 31, a performance of hitting a stick along the striking surface 31*a* is possible and a performance of simulating a drum may be performed.

Next, a method for mounting the head 30 (the membrane member 31) to the frame 20 (applying the tension) is described with reference to FIG. 4. FIG. 4 shows partially enlarged cross-sectional views of the drum 10 at a cut surface corresponding to a line III-III in FIG. 1(*b*). FIG. 4(*a*) is a partially enlarged cross-sectional view of the drum 10 showing a state before the tightening force of the tension ring 50 is applied. FIG. 4(*b*) is a partially enlarged cross-sectional view of the drum 10 showing a state in which the tightening force by the tension ring 50 is applied from the state in FIG. 4(*a*). FIG. 4(*c*) is a partially enlarged cross-sectional view of the drum 10 showing a state in which the tightening force by the tension ring 50 is further applied from the state in FIG. 4(*b*). FIG. 4(*d*) is a partially enlarged cross-sectional view of the drum 10 showing a state in which the tightening force by the tension ring 50 is further applied from the state of FIG. 4(*c*).

As shown in FIG. 4(*a*), when the head 30 is mounted to the frame 20, first, a periphery (edge) part of the striking surface 31*a* of the membrane member 31 is supported from below by the frame 20, and the upper surface side (the side in the axial direction) (the arrow U direction side) is covered by the membrane member 31 (a supporting process). Since an outer diameter of the membrane member 31 is set larger than an outer diameter of the frame 20, the frame member 32 is disposed on the lower surface side of the frame 20 by winding the membrane member 31 around the lower surface side (the other side in the axial direction) (the arrow D direction side) of the frame 20 in a state that the upper surface side of the frame 20 is covered with the membrane member 31.

Moreover, in the embodiment, an inner diameter of the frame member 32 and the outer diameter of the frame 20 are formed substantially the same in the pre-tightening state, but the inner diameter of the frame member 32 may also be configured slightly larger than the outer diameter of the frame 20.

Next, in a state that the frame member 32 is arranged on the lower surface side of the frame 20, the ring member 40 is hooked on the frame member 32 (the frame member 32 is fitted between the upper protruding portion 42 and the lower protruding portion 43 of the ring member 40). Since the ring member 40 is formed in a manner that an opposed interval between the upper protruding portion 42 and the lower protruding portion 43 in the axial direction is larger than the axial dimension of the frame member 32, a work of hooking the ring member 40 on the frame member 32 may be easily performed.

In addition, since the outer diameter of the frame member 32 in the pre-tightening state is set larger than the inner diameter of the ring member 40 (the upper protruding portion 42 and the lower protruding portion 43), even if the ring member 40 is about to fall off the frame member 32, it may be restricted by the hooking of the upper protruding portion 42 or the lower protruding portion 43 with the frame member 32. In other words, once the ring member 40 is hooked on the frame member 32, the frame member 32 may be suppressed from falling off the ring member 40 until the diameter of the frame member 32 is reduced (or the diameter of the ring member 40 is enlarged), and thus work of mounting the head 30 to the frame 20 may be performed easily.

Next, the tension ring 50 is disposed on an outer peripheral side of the ring member 40, and the bolt 56 (see FIG. 1 or FIG. 2) is tightened in a state that the outer peripheral portion 41 of the ring member 40 and the tightening portion 51 of the tension ring 50 are in contact with each other (a tightening process). Thereby, the diameter of the tightening portion 51 of the tension ring 50 is reduced, and the diameter of the ring member 40 is also reduced along with the reduction.

As shown in FIG. 4(*b*), when the diameter of the ring member 40 is reduced from the state shown in FIG. 4(*a*) due to the tightening force of the tension ring 50, an edge portion 31*b* of the membrane member 31 is pressed radially inward by the upper protruding portion 42 of the ring member 40. Moreover, the edge portion 31*b* of the membrane member 31 is a site positioned slightly on an inner peripheral side of a connection portion between the membrane member 31 and the frame member 32 (a site among the sites wound around the frame 20 in the membrane member 31 and positioned below the frame 20).

If the edge portion 31*b* of the membrane member 31 is pressed radially inward, the frame member 32 is displaced upward (toward the arrow U direction side) so as to approach the frame 20. Since the displacement of the frame member 32 is restricted by the upper protruding portion 42, the frame member 32 may be suppressed from falling off the ring member 40 at the time of this displacement.

In this case, if it is directed to merely restrict the upward displacement of the frame member 32 by the upper protruding portion 42, for example, a configuration in which the lower protruding portion 43 of the ring member 40 is omitted may be employed. However, in this configuration, a diameter of a lower end side of the ring member 40 in which the lower protruding portion 43 is not formed is prone to be reduced (prone to be deformed), and there is a risk that the frame member 32, the ring member 40, and the entire tension ring 50 may be inclined with respect to the axial direction. Therefore, there is a risk that an appearance may deteriorate due to the inclination, the tension may be difficult to be uniformly applied to the membrane member 31, or the frame member 32 may fall off the ring member 40.

On the other hand, in the embodiment, the upper protruding portion 42 and the lower protruding portion 43 are formed on both the upper and lower ends of the ring member 40, and protrusion dimensions of the upper protruding portion 42 and the lower protruding portion 43 from the outer peripheral portion 41 are substantially the same. Thereby, the entire ring member 40 may be uniformly reduced by the tightening force of the tension ring 50. Therefore, when the diameter of the ring member 40 is reduced, the frame member 32, the ring member 40, and the entire tension ring 50 may be prevented from being inclined with respect to the axial direction. Therefore, the appearance of the drum 10 may be improved, and the tension may be uniformly applied to the membrane member 31.

As shown in FIG. 4(*c*), if the diameter of the ring member 40 is further reduced from the state shown in FIG. 4(*b*) by the tightening force of the tension ring 50, the edge portion 31*b* of the membrane member 31 is further pressed radially inward by the upper protruding portion 42 of the ring member 40, and the frame member 32 and the outer peripheral portion 41 of the ring member 40 come into contact with each other. That is, in addition to the membrane member 31, the frame member 32 is also tightened radially inward by the tension ring 50. Since the frame member 32 has a predetermined elasticity, the diameter of the frame member 32 is reduced to be smaller than in the pre-tightening state by applying the radially inward tightening force of the tension ring 50 to the frame member 32. By reducing the diameter of the frame member 32, the outer edge of the membrane member 31 is pressed radially inward, and the tension is applied to the membrane member 31.

Accordingly, in order to press the outer edge of the membrane member 31 radially inward by reducing the diameter of the frame member 32, for example, a configuration may also be employed in which the upper protruding portion 42 of the ring member 40 is omitted (or the protrusion dimension of the upper protruding portion 42 is shortened) and only the frame member 32 is pressed radially inward. However, in this configuration, tensile stress easily acts on the connection portion between the membrane member 31 and the frame member 32, and thus there is a risk that the membrane member 31 may be broken or the membrane member 31 may be detached from the frame member 32.

On the other hand, in the embodiment, the upper protruding portion 42 of the ring member 40 is formed in a manner that the protrusion dimension from the outer peripheral portion 41 is longer than a radial dimension of the frame member 32. Accordingly, as shown in FIG. 4(*d*), if the diameter of the ring member 40 is further reduced from the state shown in FIG. 4(*c*), the membrane member 31 is pressed radially inward by the upper protruding portion 42, and the frame member 32 is also pressed radially inward by the outer peripheral portion 41 at the same time. That is, since the diameter of the frame member 32 is also reduced following the reduction of the diameter of the edge portion 31*b* of the membrane member 31, the tensile stress acting on the connection portion between the membrane member 31 and the frame member 32 may be reduced. Therefore, the membrane member 31 may be suppressed from being broken or suppressed from being detached from the frame member 32.

If the tightening force of the tension ring 50 reaches a predetermined magnitude, the edge portion 31*b* of the membrane member 31 is wound around the lower surface side of the frame 20 by the upper protruding portion 42 of the ring member 40. Thereby, the head 30 is mounted to the frame 20, and a state that the performance is possible (the tightening state) is obtained.

As described above, according to the drum 10 of the embodiment, since the the drum 10 has the configuration in which the frame member 32 to which the entire outer edge of the membrane member 31 is connected is wound around the lower surface side of the frame 20 and the frame member 32 is pressed radially inward, the outer edge of the membrane member 31 may be uniformly pressed radially inward over the entire circumference. Therefore, the tension may be uniformly applied to the entire membrane member 31.

Next, drums 210 and 310 in second and third embodiments are described with reference to FIGS. 5(*a*)-5(*c*). Moreover, the same symbols are attached to the parts the same as the first embodiment, and the description is omitted.

Figure 5C:
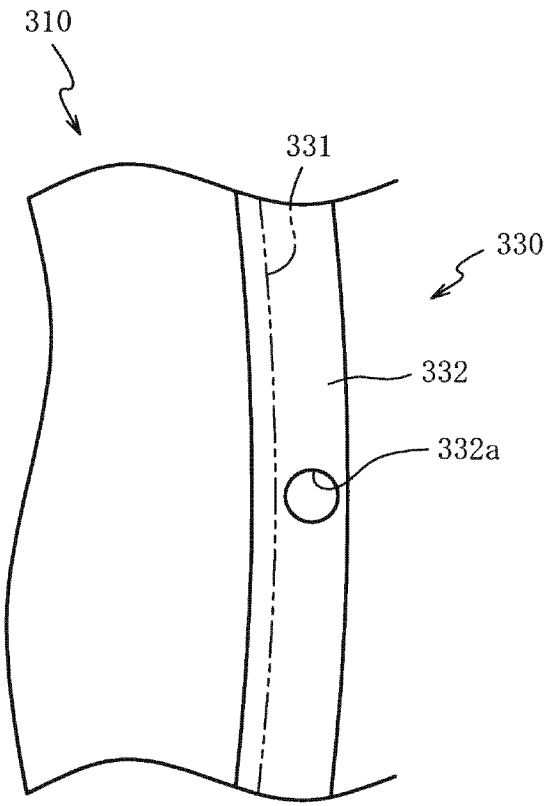
FIG. 5(*a*) is a partially enlarged top view of a head of a drum in a second embodiment, FIG. 5(*b*) is a partially enlarged side view of the head as viewed in a direction of an arrow Vb in FIG. 5(*a*), and FIG. 5(*c*) is a partially enlarged top view of a head of a drum in a third embodiment.
Figure 5B:
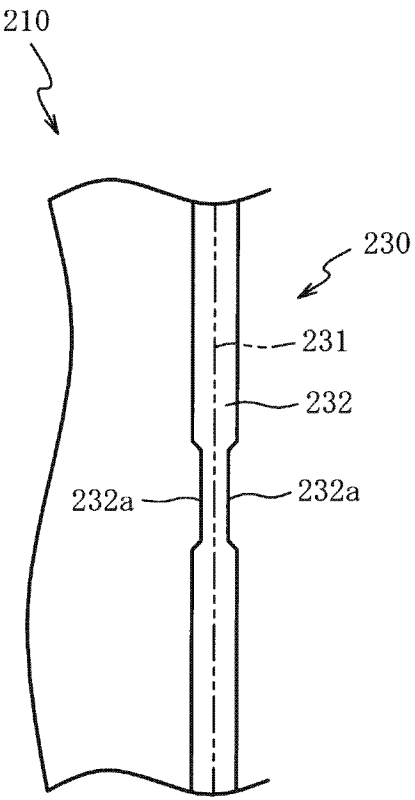
Figure 5A:
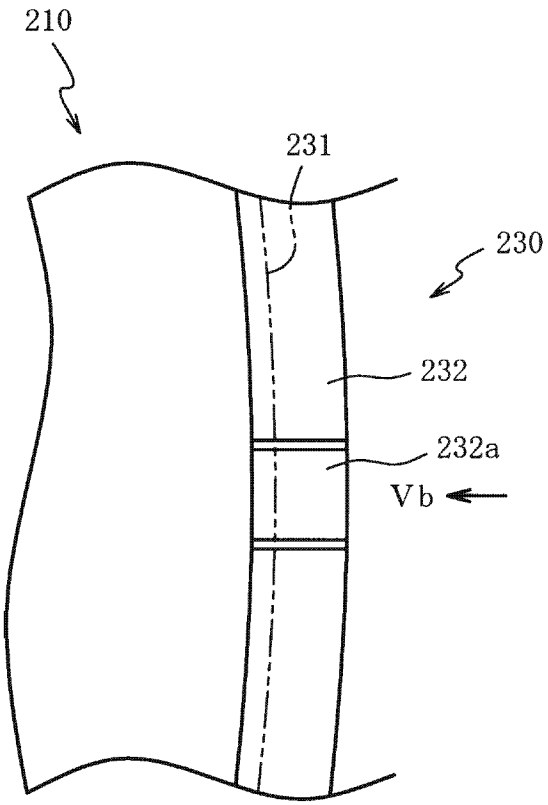

FIG. 5(*a*) is a partially enlarged top view of a head 230 of the drum 210 in the second embodiment, and FIG. 5(*b*) is a partially enlarged side view of the head 230 as viewed in a direction of an arrow Vb in FIG. 5(*a*). FIG. 5(*c*) is a partially enlarged top view of a head 330 of the drum 310 in the third embodiment. Moreover, in FIG. 5(*a*) to FIG. 5(*c*), end portions of membrane members 231 and 331 are indicated by two-dot chain lines.

As shown in FIG. 5(*a*) and FIG. 5(*b*), in the head 230 of the drum 210 in the second embodiment, concave portions 232*a* which is recessed are formed on both the upper and lower (in the axial direction) surfaces of a frame member 232. In the embodiment, a plurality of concave portions 232*a* is formed in the frame member 232 at equal intervals in the circumferential direction, but only one concave portion 232*a* is shown in FIG. 5(*a*) and FIG. 5(*b*).

In a region where the concave portion 232*a* is formed, a thickness dimension of the frame member 232 in the axial direction is formed smaller than in other regions (regions where the concave portion 232 is not formed). Thereby, when the radially inward tightening force of the tension ring 50 (see FIG. 3) acts on the frame member 232, the diameter of the frame member 232 may be easily reduced. In addition, since the plurality of concave portions 232*a* is formed in the frame member 232 at equal intervals in the circumferential direction, the diameter of the frame member 232 may be easily reduced uniformly over the entire circumference.

In this case, the concave portions 232*a* are disposed at positions different from the split portion 40*a* (see FIG. 1 or FIG. 2) of the ring member 40 in the circumferential direction according to an embodiment of the disclosure, and the concave portions 232*a* are disposed at positions different from the split portion 50*a* (see FIG. 1 or FIG. 2) of the tension ring 50 according to an embodiment of the disclosure. By disposing the concave portions 232*a* at positions different from the split portions 40*a* and 50*a* which are easy to greatly deform in the radial direction, the diameter of the frame member 232 may be easily reduced uniformly over the entire circumference.

As shown in FIG. 5(*c*), in the head 330 of the drum 310 in the third embodiment, through holes 332*a* which penetrate vertically (in the axial direction) are formed in the frame member 332. In the embodiment, a plurality of through holes 332*a* is formed in the frame member 332 at equal intervals in the circumferential direction, but only one through hole 332*a* is shown in FIG. 5(*c*).

In regions where the through holes 332*a* are formed, a thickness dimension of the frame member 332 in the radial direction is formed smaller than in other regions (regions where the through holes 332*a* are not formed). Thereby, when the radially inward tightening force of the tension ring 50 (see FIG. 3) acts on the frame member 332, a diameter of the frame member 332 may be easily reduced. Since the plurality of through holes 332*a* is formed in the frame member 332 at equal intervals in the circumferential direction, the diameter of the frame member 332 may be easily reduced uniformly over the entire circumference.

In this case, the through holes 332*a* are disposed at positions different from the split portion 40*a* (see FIG. 1 or FIG. 2) of the ring member 40 in the circumferential direction according to an embodiment of the disclosure, and the through holes 332*a* are disposed at positions different from the split portion 50*a* (see FIG. 1 or FIG. 2) of the tension ring 50 according to an embodiment of the disclosure. By disposing the through holes 332*a* at positions different from the split portions 40*a* and 50*a* which are easy to greatly deform in the radial direction, the diameter of the frame member 332 may be easily reduced uniformly over the entire circumference.

Next, drums 410, 510 and 610 according to a fourth embodiment to a sixth embodiment are described with reference to FIG. 6. Moreover, the same symbols are attached to the parts the same as the first embodiment, and the description is omitted.

Figure 6A:
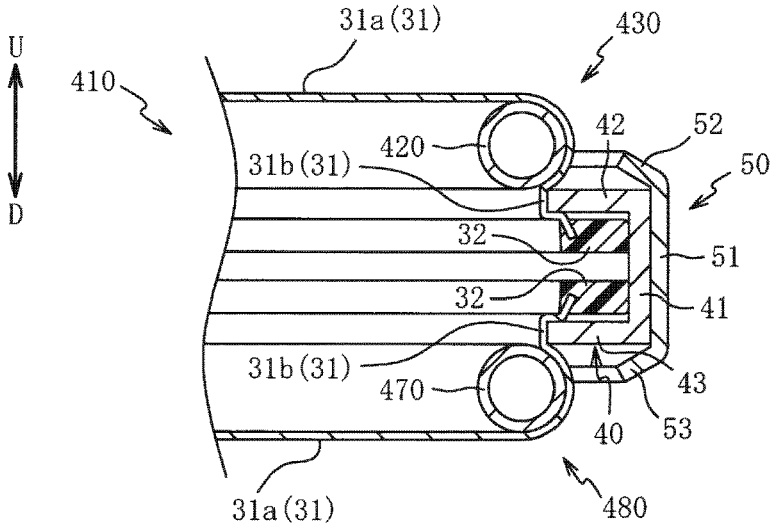
FIG. 6(*a*) is a partially enlarged cross-sectional view of a drum in a fourth embodiment, FIG. 6(*b*) is a partially enlarged cross-sectional view of a drum in a fifth embodiment, and FIG. 6(*c*) is a partially enlarged cross-sectional view of a drum in a sixth embodiment.
Figure 6B:
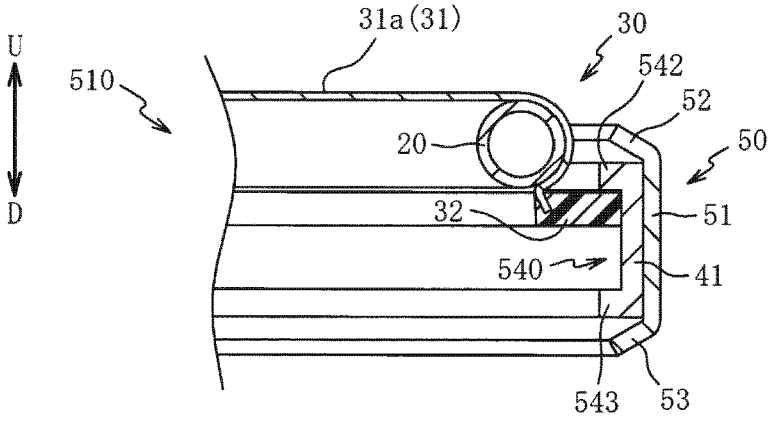
Figure 6C:
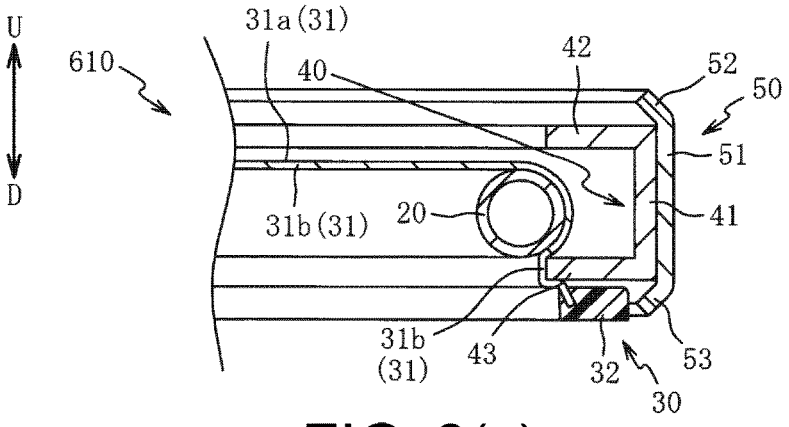

FIG. 6(*a*) is a partially enlarged cross-sectional view of the drum 410 in the fourth embodiment, FIG. 6(*b*) is a partially enlarged cross-sectional view of the drum 510 in the fifth embodiment, and FIG. 6(*c*) is a partially enlarged cross-sectional view of the drum 610 in the sixth embodiment. Moreover, FIG. 6(*a*) to FIG. 6(*c*) correspond to a cross section along the line III-III in FIG. 1(*b*).

As shown in FIG. 6(*a*), the drum 410 in the fourth embodiment includes a first frame 420, a first head 430 supported by the first frame 420, and a second frame 470 disposed on a lower surface side (the other side in the axial direction) (the arrow D direction side) of the first frame 420, a second head 480 supported by the second frame 470, and a ring member 40 and a tension ring 50 for applying tension to the first head 430 and the second head 480.

Moreover, the first frame 420 and the second frame 470 have the same configuration as the frame 20 in the first embodiment, and the first head 430 and the second head 480 have the same configuration as the head 30 in the first embodiment, and thus descriptions thereof are omitted. That is, the drum 410 of the embodiment has the same configuration as the drum 10 of the first embodiment except that the second frame 470 and the second head 480 are added.

The first frame 420 and the first head 430 are arranged in plane symmetry with the second frame 470 and the second head 480 across a plane along a direction perpendicular to the axis (a direction perpendicular to the arrow U-D). That is, in the second head 480, the membrane member 31 is wound around an upper surface side of the second frame 470, and the frame member 32 to which the outer edge of the membrane member 31 is connected is arranged on the upper surface side of the second frame 470.

The frame member 32 of the first head 430 and the frame member 32 of the second head 480 are respectively housed in an inner peripheral side of the tension ring 50. Accordingly, by reducing the diameter of one tension ring 50, a tension may be applied to each membrane member 31 of the first head 430 and the second head 480. Therefore, the number of components may be reduced compared with the case in which the tension is applied to each of the first head 430 and the second head 480 by separate tension rings 50.

Furthermore, since the tension is applied to each membrane member 31 of the first head 430 and the second head 480 by one tension ring 50, the tensions applied to the membrane members 31 may be made substantially the same in each of the first head 430 and the second head 480. Thereby, a work which makes the tensions of the membrane member 31 of the first head 430 and the membrane member 31 of the second head 480 consistent with each other is not required.

Furthermore, by applying the tension to each membrane member 31 of the first head 430 and the second head 480 by one tension ring 50, a function of connecting the first frame 420 and the second frame 470 may be given to the tension ring 50. That is, even when the first frame 420 and the second frame 470 are configured separately, it may be unnecessary to separately arrange a member for connecting the first frame 420 and the second frame 470.

As shown in FIG. 6(*b*), the drum 510 in the fifth embodiment is configured the same as the drum 10 in the first embodiment except that protrusion dimensions of an upper protruding portion 542 and a lower protruding portion 543 of a ring member 540 are formed smaller than the protrusion dimensions of the upper protruding portion 42 and the lower protruding portion 43. Specifically, the protrusion dimensions of the upper protruding portion 542 and the lower protruding portion 543 from an outer peripheral portion 41 of the ring member 540 are formed to be smaller than the radial dimension of the frame member 32.

Accordingly, only the frame member 32 may be pressed radially inward by the outer peripheral portion 41 of the ring member 540. Therefore, a tension may be applied to the membrane member 31 without clamping the upper protruding portion 542 between the frame 20 and the frame member 32, and thus an axial dimension of the drum 510 may be reduced.

In addition, if a diameter of the ring member 540 is reduced, the frame member 32 is deformed by being pressed by the outer peripheral portion 41, and the diameter of the frame member 32 is reduced. Here, since the membrane member 31 has a lower rigidity than the frame member 32, if there is a configuration in which the membrane member 31 is pressed by the ring member 540 in which the split portion 40*a* (see FIG. 1 or FIG. 2) is formed, there is a risk that the tension applied to the membrane member 31 is not uniform around the split portion 40*a*.

On the other hand, in the embodiment, since there is the configuration in which only the frame member 32 having a higher rigidity than the membrane member 31 is pressed by the ring member 540, the tension applied to the membrane member 31 may be suppressed from being not uniform around the split portion 40*a*. Therefore, the tension may be uniformly applied to the entire membrane member 31.

As shown in FIG. 6(*c*), in the drum 610 in the sixth embodiment, the lower protruding portion 43 of the ring member 40 is in contact with the edge portion 31*b* of the membrane member 31, and the upper protruding portion 42 is positioned on an upper side (one axial side) (the arrow U direction side) of the striking surface 31*a* of the membrane member 31.

If the diameter of the ring member 40 is reduced, the edge portion 31*b* of the membrane member 31 is pressed radially inward by the lower protruding portion 43, and a tension is applied to the membrane member 31. If the edge portion 31*b* of the membrane member 31 is pressed radially inward, the diameter of the frame member 32 is reduced, and thus the outer edge of the membrane member 31 may be pressed uniformly radially inward over the entire circumference. Therefore, the tension may be uniformly applied to the entire membrane member 31.

In addition, since the upper protruding portion 42 of the ring member 40 is positioned on the upper side (the one axial side) (the arrow U direction side) of the striking surface 31*a* of the membrane member 31, a performance simulating a rim shot may be performed by hitting the upper protruding portion 42 of the ring member 40 or the upper support portion 52 of the tension ring 50 with a stick or the like (not shown). In addition, an edge portion of the striking surface 31*a* may be protected by the outer peripheral portion 41 and the upper protruding portion 42. That is, the ring member 40 may have both a function for uniformly applying a tightening force of the tension ring 50 to the frame member 32 and a function which enables the performance simulating a rim shot (protects the edge portion of the striking surface 31*a*), and thus the number of components may be reduced.

In addition, the opposed interval between the upper protruding portion 42 and the lower protruding portion 43 of the ring member 40 is formed to be larger than the axial dimension of the frame 20, and in the tightening state, a part of the frame 20 is housed in the opposed interval the upper protruding portion 42 and the lower protruding portion 43. That is, since protruding front ends of the upper protruding portion 42 and the lower protruding portion 43 are disposed radially inward from an outer edge of the frame 20, the edge portion of the striking surface 31*a* may be more effectively protected by the outer peripheral portion 41 and the upper protruding portion 42 of the ring member 40.

Moreover, the diameter of the frame member 32 may be reduced in a manner that a lower support portion 53 is brought into contact with an outer peripheral surface of the frame member 32 and the lower support portion 53 presses the frame member 32 radially inward.

In addition, the lower support 53 may be brought into contact with a lower surface of the frame member 32. Thereby, the frame member 32 may be suppressed displacing to a lower side (the other axial side) (the arrow D direction). In addition, a rotation in which a connection portion between the edge portion 31*b* of the membrane member 31 and the frame member 32 is taken as a fulcrum and by which the lower surface of the frame member 32 approaches the lower protruding portion 43 (hereinafter simply referred to as "the rotation of the frame member 32") may be suppressed. By suppressing the displacement of the frame member 32 in the axial direction or the rotation of the frame member 32, a tension may be applied uniformly to the entire membrane member 31.

Although the disclosure is described above based on the embodiments, the disclosure is not limited to the above forms at all, and it may be easily assumed that various modification improvement is possible within the range not departing from the gist of the disclosure. Therefore, for example, a drum may be configured by combining a part or all of any of the above embodiments with a part or all of the other embodiments.

In each of the above embodiments, the case in which the frame member 32 is formed using a synthetic resin has been described, but the disclosure is not necessarily limited thereto, and the frame member 32 may be formed using a metal material. In addition, the frame member may be formed in a manner of wraping a resin material (a metal material) with a metal material (a resin material). That is, the material forming the frame member 32 is not limited as long as the material has elasticity enough to be elastically deformed (not plastically deformed) by the tightening force of the tension ring 50. For example, even when the frame member 32 is formed using a metal material, the diameter of the frame member 32 may be easily reduced by forming the concave portion 232 or the through hole 332*a* in the frame member 32 as in the second embodiment or the third embodiment.

In each of the above embodiments, the case in which the frame member 32 is connected over the entire circumference of the outer edge of the membrane member 31 (the frame member 32 is formed in an annular shape which is continuous in the circumferential direction) has been described, but the disclosure is not necessarily limited thereto. For example, the frame member 32 may be divided and formed in the circumferential direction.

In each of the above embodiments, the case in which the frame member 32 is formed in a horizontally long rectangle in a cross-sectional view cut along a plane along the axis has been described, but the disclosure is not necessarily limited thereto, and the cross-sectional shape of the frame member 32 may be formed in a vertically long rectangle or a square shape. In addition, the cross-sectional shape may be formed in a substantially circular shape, or may be formed in a triangular shape or a polygonal shape having five or more sides.

In each of the above embodiments, the cases in which the drums 10, 210, 310, 410, 510, and 610 include the ring members 40, 540 have been described, but the disclosure is not necessarily limited thereto, and the ring members 40, 540 may be omitted and the frame member 32 may be directly pressed radially inward by the tension ring 50. In this case, if the tension ring 50 is configured with the same configuration (the cross-sectional shape or the mounting method) as the ring members 40, 540 described in each of the above embodiments, the same effects as the ring members 40, 540 may be obtained.

In other words, a function of applying a tightening force in the radial direction may be given to the ring members 40, 540 by arranging the coupling members 54, 55 or the bolt 56 around the split portions 40*a* of the ring members 40, 540, and the tension ring 50 may be omitted. In this case, the ring members 40, 540 correspond to the tension ring of claim 1.

In each of the above embodiments, the cases in which the split portions 40*a* are formed in the ring members 40, 540 have been described, but the disclosure is not necessarily limited thereto. For example, if the ring members 40, 540 have enough elasticity so as to be elastically deformed (not plastically deformed) by the tightening force of the tension ring 50, the split portion 40*a* may be omitted, and the ring members 40, 540 may be formed in an annular shape which is continuous in the circumferential direction.

When the split portion 40*a* is omitted, the inner diameters of the upper protruding portions 42, 542 or the lower protruding portions 43, 543 of the ring members 40, 540 are formed slightly smaller than the outer diameter of the frame member 32, and the frame member 32 is elastically deformed, and thereby the frame member 32 may be housed in the space surrounded by the outer peripheral portion 41, the upper protruding portions 42, 542, and the lower protruding portions 43, 543.

In addition, when the split portion 40*a* is omitted, the lower protruding portions 43, 543 of the ring members 40, 540 may be omitted, and the frame member 32 may be fitted from the lower surface side (the arrow D direction side) of the ring members 40, 540. In this case, by setting the inner diameters of the upper protruding portions 42, 542 larger than the outer diameter of the frame 20 (configuring in a manner that the frame 20 may pass through the inner peripheral sides of the upper protruding portions 42, 542), the head 30 may be mounted to the head 20.

In each of the above embodiments, the case in which the split portions 40*a*, 50*a* are respectively formed at one place in the ring members 40, 540 and the tension ring 50 has been described, but the disclosure is not necessarily limited thereto, and the split portions 40*a*, 50*a* may be formed at a plurality of places in the circumferential direction.

In each of the above embodiments, the cases in which the displacement in the axial direction of the ring members 40, 540 is restricted by the upper support portion 52 and the lower support portion 53 of the tension ring 50 have been described, but the disclosure is not necessarily limited thereto, and the displacement in the axial direction or the rotation (rotation of the outer peripheral portion 41 being inclined with respect to the axial direction) of the ring member 40, 540 may be restricted by forming convex portions in one of the ring members 40, 540 and the tension ring 50, forming concave portions in the other, and fitting these convex portions and concave portions with each other.

Moreover, the convex portions and the concave portions are formed continuously in the circumferential direction according to an embodiment of the disclosure, or the concave portions are formed longer in the circumferential direction than the convex portions. That is, when the tension ring 50 is tightened, the tension ring 50 is deformed to slide (relatively displace) on the outer peripheral surfaces of the ring members 40, 540. Therefore, for example, if the convex portions or the concave portions having the same circumferential length are formed intermittently in the circumferential direction, the relative displacement in the circumferential direction of the tension ring 50 with respect to the ring members 40, 540 becomes impossible, and the tightening force of the tension ring 50 is difficult to be applied to the ring member 40.

On the other hand, by continuously forming the convex portions and the concave portions in the circumferential direction, or forming the concave portions longer in the circumferential direction than the convex portions, the relative displacement in the circumferential direction of the tension ring 50 with respect to the ring members 40, 540 is possible, and the tightening force of the tension ring 50 may be applied to the ring members 40, 540. In addition, by forming the concave portions longer than the convex portions in the circumferential direction, even if the tension ring 50 is relatively displaced in the circumferential direction with respect to the ring members 40, 540, the fitting between the convex portions and the concave portions may be maintained.

Similarly, the displacement of the frame member 32 in the axial direction or the rotation of the frame member 32 may be restricted by forming convex portions on one of the frame member 32 and the ring members 40, 540, forming concave portions on the other, and fitting these convex portions and concave portions with each other.

In each of the above embodiments, the cases in which the opposed intervals between the upper protruding portions 42, 542 and the lower protruding portions 43, 543 of the ring members 40, 540 are formed larger than the axial dimension of the frame member 32 have been described, but the disclosure is not necessarily limited thereto. For example, the opposed intervals between the upper protruding portions 42, 542 and the lower protruding portions 43, 543 may be formed the same as the axial dimension of the frame member 32 (or large enough to restrict the rotation of the frame member 32).

Accordingly, the rotation of the frame member 32 may be restricted by clamping the entire frame member 32 from above and below by the upper protruding portions 42, 542 and the lower protruding portions 43, 543. Therefore, for example, the shape of the frame member 32 or the ring member 40 may be suppressed from becoming complicated compared with a case in which concaves and convexes (which restrict the rotation of the frame member) which may be fitted to each other are formed on the outer peripheral surface of the frame member 32 or the inner peripheral surfaces of the ring members 40, 540. In addition, by clamping the entire frame member 32 from above and below by the upper protruding portions 42, 542 and the lower protruding portions 43, 543, the displacement of the frame member 32 in the axial direction or the rotation of the frame member 32 is suppressed, and thereby the tension may be uniformly applied to the entire membrane member 31.

In each of the above embodiments, the connection portion between the outer peripheral portion 41 of the ring members 40, 540 and the upper protruding portions 42, 542 or the lower protruding portions 43, 543 may be formed in a rounded shape. In this case, according to an embodiment of the disclosure, substantially the same roundness is formed at corners of the frame member 32.

In each of the above embodiments, the case in which the frame 20 is formed in a hollow annular shape has been described, but the disclosure is not necessarily limited thereto. For example, the frame 20 may be solid, or the frame 20 may be formed in a solid circular-columnar shape or a circular-cylindrical shape. When the frame 20 is formed in a circular-columnar shape or a circular-cylindrical shape, a convex portion (which protrudes in the radial direction and is formed continuously in the circumferential direction) is formed on the outer peripheral surface of the frame 20, and the frame member 32 may be tightened by the tension ring 50 in a state that the frame member 32 is disposed on the lower surface side of the convex portion. Thereby, the diameter of the frame member 32 may be reduced and the tension may be applied to the membrane member 31 (in this case, the lower surface of the convex portion corresponds to "the other side in the axial direction of the frame" in claim 1).

Moreover, the circular-columnar shape or the circular-cylindrical shape means a columnar shape or a cylindrical shape extending at least in the axial direction (the arrow U-D direction), and the outer diameter (an outer diameter or an inner diameter in the cylindrical shape) of the frame 20 may change in a part from the upper end side to the lower end side (a site protruding on the outer peripheral surface of the frame 20 (an outer peripheral surface or an inner peripheral surface in the cylindrical shape) may be arranged). In addition, the cross section of the frame 20 may be configured of a polygon including a quadrangle, an ellipse, or a shape in which straight lines and curves are combined. That is, no matter what the shape of the frame 20 is, as long as a ring-like convex portion (a site around which the membrane member 31 may be wound) is formed on the outer peripheral surface on the upper end side of the frame 20, technical ideas of each of the above embodiments may be applied.

In each of the above embodiments, the case in which the frame 20 is formed in an annular shape has been described, but the disclosure is not necessarily limited thereto. For example, a disk may be connected to the lower surface side opposite to the side on which the head 30 of the frame 20 is wound, and a bottom surface of the frame 20 is formed by the disk (the frame 20 isn formed in a tray (container) shape in which a side in an axial direction is open). In addition, a hole may be formed in an axial center of the disk (the bottom surface of the frame 20), or a plurality of holes may be formed in the disk. In addition, a plurality of holes may be formed in the disk (the bottom surface of the frame 20), and the disk may be formed in a spoke shape.

In each of the above embodiments, the cases in which the ring members 40, 540 restrict the rotation of the frame member 32 have been described, but the disclosure is not necessarily limited thereto, and when the ring members 40, 540 are pressed, the tension may be applied to the membrane member 31 while the frame member 32 is rotated (rotating in a manner of taking the connection portion between the edge portion 31*b* of the membrane member 31 and the frame member 32 as the fulcrum and bringing the lower surface of the frame member 32 closer the lower protruding portion 43).

In each of the above embodiments, the cases in which the coupling members 54, 55 of the tension ring 50 are connected by the bolt 56, and the diameter of the tightening portion 51 is reduced (increased) by tightening (or loosening) the bolt 56 have been described, but the disclosure is not necessarily limited thereto. For example, a quick lever may be used instead of the coupling members 54, 55 and the bolt 56. Moreover, in the quick lever, a lever and a cam are arranged on the same rotation axis, and the cam is rotated by rotating the lever around the rotation axis, and by the quick lever, the diameter of the tightening portion 51 may be reduced (increased). In addition, the coupling members 54, 55 and the bolt 56 and the quick lever may be used together. Thereby, the tightening force may be adjusted by operating the bolt 56, and the tightening force may be easily applied to the frame member 32 by operating the quick lever.

In the first embodiment to the fifth embodiment, the case in which the upper end of the upper support portion 52 of the tension ring 50 is disposed on the lower side (the arrow D direction side) of the striking surface 31*a* of the membrane member 31 has been described, but the disclosure is not necessarily limited thereto, and the upper end of the upper support portion 52 may be arranged on the upper side (the arrow U direction side) of the striking surface 31*a* of the membrane member 31. Thereby, the performance simulating the rim shot may be performed by hitting the upper support portion 52 with a stick or the like (not shown). Moreover, a site (a site different from the upper support portion 52) protruding further upward (toward the arrow U direction side) than the striking surface 31*a* of the membrane member 31 may be separately formed in the tension ring 50.

In the second embodiment, the case in which the concave portion 232 is formed to be recessed in the axial direction has been described, but the disclosure is not necessarily limited thereto, and the concave portion 232 may be formed to be recessed in the radial direction.

In the third embodiment, the case in which the through hole 332*a* is configured as a hole penetrating in the axial direction has been described, but the disclosure is not necessarily limited thereto, and for example, the through hole 332*a* may be a hole penetrating in the radial direction.

In the fourth embodiment, the cases in which the first frame 420 and the second frame 470 have the same configuration and the first head 430 and the second head 480 have the same configuration have been described, but the disclosure is not necessarily limited thereto. For example, the first frame 420 and the second frame 470 may have different configurations, the first head 430 and the second head 480 may have different configurations, and the first frame 420 and the second frame 470 may be respectively configured of different outer diameters, or the frame members 32 of the first head 430 and the second head 480 may be respectively configured of different outer diameters. Thereby, the tensions applied to the first head 430 and the second head 480 may be made different.

In the fourth embodiment, the case in which the protrusion dimensions of the upper protruding portion 42 and the lower protruding portion 43 from the outer peripheral portion 41 are substantially the same has been described, but the disclosure is not necessarily limited thereto, and the protrusion dimensions of the upper protruding portion 42 and the lower protruding portion 43 may be different from each other. Thereby, the tensions applied to the first head 430 and the second head 480 may be made different.

In the fourth embodiment, the inner diameter of the outer peripheral portion 41 may be made different at a position in contact with the first head 430 and a position in contact with the frame member 32 of the second head 480. Thereby, the tensions applied to the first head 430 and the second head 480 may be made different.

In the fourth embodiment, the case in which the first frame 420 and the second frame 470 are configured separately has been described, but the disclosure is not necessarily limited thereto, and the first frame 420 and the second frame 470 may be connected and configured integrally. In this case, one set of the ring member 40 and the tension ring 50 is arranged (separately) for each of the first head 430 and the second head 480, and different tensions may be applied to the first frame 420 and the second frame 470.

What is claimed is:

1. A percussion instrument, comprising:

a frame in which an outer peripheral surface of an end portion on a side in an axial direction of the frame is formed in a ring shape;

a membrane member covering the side in the axial direction of the frame;

a ring-like frame member connected to an outer edge of the membrane member and having a predetermined elasticity; and a tension ring which tightens the frame member radially inward to reduce a diameter of the frame member in a state that the frame member is disposed closer to the other side in the axial direction than the end portion of the frame on the side in the axial direction.

2. The percussion instrument according to claim 1, comprising a ring member being ring-like and clamped between an outer peripheral surface of the frame member and an inner peripheral surface of the tension ring, wherein the tension ring is formed in a ring shape comprising a split portion in which a part in a circumferential direction of the tension ring is divided, and a fastening portion which reduces or enlarges an interval of the split portion in the circumferential direction.

3. The percussion instrument according to claim 2, wherein the ring member comprises a split portion in which a part in a circumferential direction of the ring member is divided, and the split portion of the ring member is disposed at a position shifted from the split portion of the tension ring in the circumferential direction.

4. The percussion instrument according to claim 2, wherein the frame member comprises thin portions whose axial or radial dimensions are smaller than other portions of the frame member.

5. The percussion instrument according to claim 4, wherein the thin portions are arranged at positions different from the split portion of the tension ring in a circumferential direction of the frame member.

6. The percussion instrument according to claim 3, wherein a position of the split portion of the ring member is arranged on an opposite side of the split portion of the tension ring across an axis.

7. The percussion instrument according to claim 2, wherein the ring member comprises an outer peripheral portion configuring an outer peripheral surface of the ring member, an upper protruding portion which protrudes radially inward from an upper end of the outer peripheral portion, and a lower protruding portion which protrudes radially inward from a lower end of the outer peripheral portion.

8. The percussion instrument according to claim 1, wherein an upper support portion and a lower support portion are respectively formed at both axial ends of the tension ring in a manner of being inclined and projected toward both sides in the axial direction as the upper support portion and the lower support portion go radially inward.

9. The percussion instrument according to claim 7, wherein the upper protruding portion of the ring member is formed in a manner that a protrusion dimension from the outer peripheral portion is longer than a radial dimension of the frame member.

10. A percussion instrument, comprising:

a head which comprises a membrane member configuring a striking surface, and a frame member having a predetermined elasticity to which an outer edge of the membrane member is connected;

a frame which supports a peripheral part of the striking surface of the membrane member from below on an opposite side of the striking surface; and a tension ring which radially inward tightens the frame member disposed below a position at which the frame supports the membrane member to apply a tension to the head.

11. The percussion instrument according to claim 10, comprising a ring member being ring-like and clamped between an outer peripheral surface of the frame member and an inner peripheral surface of the tension ring, wherein the tension ring is formed in a ring shape comprising a split portion in which a part in a circumferential direction of the tension ring is divided, and a fastening portion which reduces or enlarges an interval of the split portion in the circumferential direction.

12. The percussion instrument according to claim 11, wherein the ring member comprises a split portion in which a part in a circumferential direction of the ring member is divided, and the split portion of the ring member is disposed at a position shifted from the split portion of the tension ring in the circumferential direction.

13. The percussion instrument according to claim 11, wherein the frame member comprises thin portions whose axial or radial dimensions are smaller than other portions of the frame member.

14. The percussion instrument according to claim 13, wherein the thin portions are arranged at positions different from the split portion of the tension ring in a circumferential direction of the frame member.

15. The percussion instrument according to claim 11, wherein the ring member comprises an outer peripheral portion configuring an outer peripheral surface of the ring member, an upper protruding portion which protrudes radially inward from an upper end of the outer peripheral portion, and a lower protruding portion which protrudes radially inward from a lower end of the outer peripheral portion, and the upper protruding portion of the ring member is formed in a manner that a protrusion dimension from the outer peripheral portion is longer than a radial dimension of the frame member.

16. A percussion instrument, comprising:

a support part in which an outer peripheral surface of an end portion on a side in an axial direction of the support part is formed in a ring shape;

a membrane member covering the side in the axial direction of the support part;

a ring-like frame member connected to an outer edge of the membrane member and having a predetermined elasticity; and a tension applying part which tightens the frame member radially inward to reduce a diameter of the frame member in a state that the frame member is disposed closer to the other side in the axial direction than the end portion of the support part on the side in the axial direction.

17. A tension applying method for applying a tension to a head which comprises a membrane member configuring a striking surface, and a frame member having a predetermined elasticity to which an outer edge of the membrane member is connected, the tension applying method comprising:

a supporting process for supporting a peripheral part of the striking surface of the membrane member from below on an opposite side of the striking surface by a frame; and a tightening process which is performed after the supporting process and in which the frame member arranged below a position where the frame supports the membrane member is tightened radially inward by a tension ring.

18. The tension applying method according to claim 17, wherein the tension ring is formed in a ring shape comprising a split portion in which a part in a circumferential direction of the tension ring is divided, and a fastening portion which reduces or enlarges an interval of the split portion in the circumferential direction; and in the tightening process, a ring member being ring-like is clamped between an outer peripheral surface of the frame member and an inner peripheral surface of the tension ring.

19. The tension applying method according to claim 18, wherein the ring member comprises a split portion in which a part in the circumferential direction of the ring member is divided; and in the tightening process, the split portion of the ring member and the split portion of the tension ring are arranged at positions shifted in the circumferential direction.

20. The tension applying method according to claim 17, wherein the frame member comprises thin portions whose axial or radial dimensions are smaller than other portions of the frame member.

* * * * *